United States Patent [19]

Beran et al.

[11] 4,406,662

[45] Sep. 27, 1983

[54] HEAT TRANSFER PRINTING ON A FILLED POLYMETHYL METHACRYLATE ARTICLE

[75] Inventors: Joseph F. Beran, Wilmington, Del.; Emery J. Gorondy, Chadds Ford, Pa.

[73] Assignee: E. I. Du Pont de Nemours and Company, Wilmington, Del.

[21] Appl. No.: 355,170

[22] Filed: Mar. 5, 1982

[51] Int. Cl.[3] ..... B41M 1/26

[52] U.S. Cl. ..... 8/471; 8/509; 8/522

[58] Field of Search ..... 8/471, 509, 522

[56] References Cited

U.S. PATENT DOCUMENTS

| | | | |
|---|---|---|---|
| 3,847,865 | 11/1974 | Duggins | 524/437 |
| 3,877,964 | 4/1975 | Orman | 8/467 |
| 4,201,821 | 5/1980 | Fromson et al. | 8/444 |
| 4,202,663 | 5/1980 | Haigh | 8/471 |
| 4,354,851 | 10/1982 | Hix et al. | 8/471 |

FOREIGN PATENT DOCUMENTS

| | | |
|---|---|---|
| 1111717 | 11/1981 | Canada . |
| 14901 | 9/1980 | European Pat. Off. . |
| 2817566 | 10/1978 | Fed. Rep. of Germany . |
| 2940370 | 4/1981 | Fed. Rep. of Germany . |
| 1463072 | 2/1977 | United Kingdom . |
| 1463596 | 2/1977 | United Kingdom . |
| 1517832 | 7/1978 | United Kingdom . |
| 2095619 | 10/1982 | United Kingdom . |

*Primary Examiner*—A. Lionel Clingman

*Attorney, Agent, or Firm*—William H. Thrower

[57] ABSTRACT

A process of heat transfer printing the surface of a filled polymeric article, wherein the filled polymeric article consists essentially of an inorganic filler, preferably alumina trihydrate, and a polymer with an affinity for disperse dyes, preferably polymethyl methacrylate. A desired design is printed onto a carrier using sublimable disperse dyes. The filled polymeric article is preheated, the carrier supporting sublimable disperse dye is placed in intimate contact with the preheated article, and sufficient heat is applied to cause the dye to sublime, then diffuse into the surface of the article.

1 Claim, No Drawings

HEAT TRANSFER PRINTING ON A FILLED POLYMETHYL METHACRYLATE ARTICLE

FIELD OF THE INVENTION

The invention involves a process of heat transfer printing the surface of a filled polymeric article, wherein the filled polymeric article consists essentially of an inorganic filler, preferably alumina trihydrate, held together with a translucent polymer cement, preferably polymethyl methacrylate. By heat transfer printing, it is meant that a desired pattern is printed onto a carrier using inks containing sublimable disperse dyes, the printed carrier is placed in contact with the surface of the filled polymeric article, and sufficient heat is applied to cause the dyes to sublime, then subsequently to diffuse into the surface of the article.

DESCRIPTION OF THE PRIOR ART

It is common commercial practice to print textile materials by subliming and transferring dyes from carriers printed or coated with disperse dyes in the form of an ink or paste. The textile material is contacted with the printed carrier in the presence of heat to cause the dyes to sublime and to diffuse into the interior of the fiber contained in the textile material. Fabrics comprised of polymers with an affinity for disperse dyes, such as polyesters, acrylics, and acetates, may be printed by this process. See, for example, Copending Application Ser. No. 098,977 of Emery J. Gorondy, filed Nov. 30, 1979; which discloses level dyeing of textile material in a solid shade by means of a heat transfer process. The carrier may be any of several appropriate materials including paper, metal, such as aluminum or steel, plastic, or fabrics optionally coated with various resins such as vinyl, polyurethane, polytetrafluoroethylene, or the like. All paper printing techniques, including gravure, lithography, rotary screen, and flexography, with their respective advantages and limitations may be used to print the carrier with the ink containing sublimable disperse dyes.

Filled polymeric materials and various methods for their manufacture are known in the art. The preparation of a polymerizable acrylic composition consisting essentially of a syrup containing methyl methacrylate polymer dissolved in monomeric methyl methacrylate (polymer-in-monomer syrup), a polymerization initiator, and an inorganic filler, preferably alumina trihydrate, is disclosed in U.S. Pat. No. 3,847,865 issued to Ray B. Duggins. The composition can be cast or molded and cured to produce a structure with an important combination of properties including translucency, weather resistance, resistance to staining by common household materials, flame resistance, and resistance to stress cracking. In addition, the cured article can be easily machined by conventional techniques including sawing and sanding. This particular combination of properties makes such a structure particularly useful as kitchen or bathroom countertops, back splash panels, molded articles such as towel racks, and the like.

The polymer constituent comprises 15 to 80%, preferably 20 to 45% by weight of the filled article and may comprise methyl methacrylate homopolymers and copolymers of methyl methacrylate with other ethylenically unsaturated compounds (e.g., vinyl acetate, styrene, alkyl acrylates, acrylonitrile, alkyl methacrylates, multifunctional acrylic monomers such as alkylene dimethacrylates and alkylene diacrylates). In. addition, the polymer constituent can contain small amounts of other polymers including minor amounts of polyester.

The filled polymeric article also contains 20 to 85%, preferably about 55 to 80% of an inorganic filler. Materials generally used as fillers are, for example, titanates, barium sulfates, calcium carbonate, lithopone, china clays, magnesite, mica, iron oxides, silicone dioxide, and various siennas. A particularly preferred filler is alumina trihydrate, disclosed in the above-referenced patent to Duggins.

While sublimation heat transfer printing utilizing disperse dyes of polymer fabrics, including polyesters, acrylics, polyamides, and acetates, and of other polymer forms including films and sheets has been known in the art, until this invention there has been no process for heat transfer printing a filled polymeric article which contains a substantial amount of inorganic filler material together with the polymeric constituent of the article.

SUMMARY OF THE INVENTION

A desired design may be printed onto the surface of a filled polymeric article containing 20 to 85% inert inorganic filler utilizing a heat transfer printing process. The design is printed onto a carrier using inks comprising sublimable disperse dyes. The filled polymeric article is preheated. The carrier with the printed design is brought into intimate contact with the surface of the preheated article and sufficient heat is applied to cause the dye to sublime and to diffuse into the surface of the article.

DETAILED DESCRIPTION OF THE INVENTION

A filled polymeric article consisting essentially of an inorganic filler held together with a translucent polymer cement may be successfully printed with a design utilizing the heat transfer process of this invention. A particularly preferred material subject to the process of this invention is a filled polymeric article consisting essentially of 20 to 85%, preferably about 55 to about 80% by weight of alumina trihydrate and 15 to 80%, preferably about 20 to about 45% by weight polymethyl methacrylate, such as that described in the above-referenced patent to Duggins. Of course, the process is applicable to articles which may contain other inorganic fillers known in the art in lieu of all or a portion of the alumina trihydrate. The article may optionally contain pigments in an amount sufficient to achieve a desired color. As discussed earlier, the polymeric constituent preferably comprises methyl methacrylate homopolymers and copolymers of methyl methacrylate with other small ethylenically unsaturated compounds, and may contain small amounts of other polymers including minor amounts of polyesters. The article printed according to the invention provides aesthetically appealing tiles and panels particularly useful as decorative wall tiles and backsplash panels and the like.

To accomplish the invention a desired design is printed onto a carrier, for example, a paper web or polyester film, in ways known in the art utilizing inks comprising known sublimable disperse dyes. The surface of the article is prepared by preheating. The carrier with the desired design is placed in intimate contact with the surface of the preheated article, and sufficient heat is applied to cause the disperse dye to sublime from the carrier into the surface of the article.

The amount of heat necessary to cause sublimation depends on the vapor pressure of the disperse dye utilized. Preheating the article before the heat transfer printing step is an essential step to assure adequate heat to promote diffusion of the sublimated dye into the surface of the article, otherwise there is uneven transfer of the dye and acceptable printing quality is not obtained.

It is also essential to the invention that the carrier with the printed design be in intimate contact with the surface of the article while applying heat to cause sublimation of the dye, otherwise an inadequate image transfer will result. Intimate contact can be assured, for example, by utilizing a heated press platen to apply the required heat of sublimation, applying sufficient pressure with the press platen to cause the carrier to come into intimate contact with the surface of the article. Lack of intimate contact between the carrier and the surface of the article may result due to the lack of flatness of the press platen, the surface of the article, or a combination of both. In such circumstances the lack of intimate contact can be overcome by preheating the article above its glass transition temperature before the heat transfer printing step so that, so softened, it will conform intimately to the surface of the heated platen.

In applying the process of this invention to an article of the preferred material consisting essentially of alumina trihydrate and polymethyl methacrylate, acceptable image transfer has been obtained by preheating the article to a temperature of at least about 96° C. To insure intimate contact between the article, the carrier with the desired design printed thereon, and the heated press platen during the heat transfer printing step, it may be desirable to heat the article to the glass transition temperature of the preferred material, about 110° C., which would soften the material and enable it to more intimately conform to the surface of the press platen. The glass transition temperature is not to be construed as the upper temperature to be utilized for preheating, however, since the preferred material has been successfully and routinely hot-shaped at higher temperatures, for example 145° C., to produce excellent finished articles.

EXAMPLE

A sheet of filled polymethyl methacrylate comprising 80% alumina trihydrate measuring 6"×6"×½" thick, was heated to 218° F. (98° C.) and placed into a heat transfer press. A sheet of garment transfer paper, printed with a sublimable disperse dye, was placed adjacent the surface of the polymeric sheet. The press was activated at 20 psi (1.4 kg/cm$^2$), the press plate contacting the garment transfer paper at 410° F., (210° C.), for a print contact time of 30 sec. There was excellent definition in transfer of the design from the garment transfer paper to the surface of the polymethyl methacrylate sheet.

We claim:

1. A process for heat transfer printing a design onto the surface of a filled polymeric article, said article consisting essentially of 55 to 80% by weight alumina trihydrate and 20 to 45% by weight polymethyl methacrylate, said process comprising preheating said article to a temperature of at least about 96° C., placing a carrier supporting sublimable disperse dye adjacent to said surface of said preheated article, said disperse dye forming a design, and applying sufficient heat to said carrier in intimate contact with said surface to cause said disperse dye to sublime and to diffuse into said surface.

* * * * *